US010559910B2

(12) United States Patent
Xu et al.

(10) Patent No.: US 10,559,910 B2
(45) Date of Patent: Feb. 11, 2020

(54) ELECTRICAL CONNECTOR HAVING INSTERT-MOLDING CONTACT MODULE EMBEDDED WTIHIN A PAIR OF OVER-MOLDING COVERS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yin-Chao Xu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/362,695

(22) Filed: Mar. 25, 2019

(65) Prior Publication Data

US 2019/0296476 A1 Sep. 26, 2019

(30) Foreign Application Priority Data

Mar. 23, 2018 (CN) ..... 2018 1 0246030

(51) Int. Cl.

| | |
|---|---|
| ***H01R 13/504*** | (2006.01) |
| ***H01R 12/70*** | (2011.01) |
| ***H01R 13/6582*** | (2011.01) |
| ***H01R 43/24*** | (2006.01) |
| ***H01R 12/72*** | (2011.01) |
| ***H01R 13/42*** | (2006.01) |
| *H01R 13/405* | (2006.01) |

(52) U.S. Cl.

CPC ..... *H01R 13/504* (2013.01); *H01R 12/7005* (2013.01); *H01R 12/724* (2013.01); *H01R 13/42* (2013.01); *H01R 13/6582* (2013.01); *H01R 43/24* (2013.01); *H01R 13/405* (2013.01)

(58) Field of Classification Search

CPC ..... H01R 13/405; H01R 13/504; H01R 43/24
See application file for complete search history.

(56) References Cited

U.S. PATENT DOCUMENTS 5,647,751 A * 7/1997 Shulman ..... H01R 13/504 439/106
6,290,512 B1 * 9/2001 Mullen, Jr. ..... H01R 13/506 439/106

(Continued)

FOREIGN PATENT DOCUMENTS

TW 201711304 3/2017

*Primary Examiner* — Tho D Ta
(74) *Attorney, Agent, or Firm* — Wei Te Chung; Ming Chieh Chang

(57) ABSTRACT

An electrical connector includes a contact module enclosed within a pair of over-molding covers. The contact module includes one row of contacts retained in an insulator via an insert-molding process. Each cover includes a rear base part and a front tongue part extending forwardly from the base part. Each contact has a front contacting section exposed upon the tongue in a vertical direction, and a rear tail section exposed outside of the base. The contacts are exposed upon only one tongue part in the vertical direction.

20 Claims, 7 Drawing Sheets

(56) References Cited

U.S. PATENT DOCUMENTS

| | | | | |
|---|---|---|---|---|
| 7,485,013 | B2 * | 2/2009 | Kuo | H01R 9/03 439/731 |
| 9,231,319 | B2 | 1/2016 | Hon Hai | |
| 9,853,393 | B2 * | 12/2017 | Guo | H01R 13/405 |

* cited by examiner

ELECTRICAL CONNECTOR HAVING INSTERT-MOLDING CONTACT MODULE EMBEDDED WTIHIN A PAIR OF OVER-MOLDING COVERS

BACKGROUND OF THE INVENTION

1. Field of the Invention

The present invention relates generally to an electrical connector, and more particularly to the electrical connector having a contact module embedded within a pair of over-molding covers.

2. Description of Related Arts

U.S. Pat. No. 9,231,319 discloses an electrical connector provided with a metallic shell receiving a contact module therein while exposing the contacting sections of the contacts to an exterior. Because the gap between the shell and the contact module is inevitable that may jeopardize the mechanical and electrical performance of the connector, an insulative over-molding cover applied upon the contact module without any gap therebetween is an approach. Anyhow, a single over-molding cover to circumferentially cover the contact module may result in an uneven exterior surface thereof with a not good-looking appearance due to the positioning/core pins which are used to hold the contact module in position during the over-molded procedure.

An electrical connector with no gap between the shell and the contact module and a good-looking appearance is desired.

SUMMARY OF THE INVENTION

An object of the invention is to provide an electrical connector with a contact module enclosed within a pair of over-molding covers. The contact module includes one row of contacts retained in an insulator via an insert-molding process. Each cover includes a rear base part and a front tongue part extending forwardly from the base part. Each contact has a front contacting section exposed upon the tongue in a vertical direction, and a rear tail section exposed outside of the base. The contacts are exposed upon only one tongue part in the vertical direction.

DETAILED DESCRIPTION OF THE PREFERRED EMBODIMENT

Figure 1:
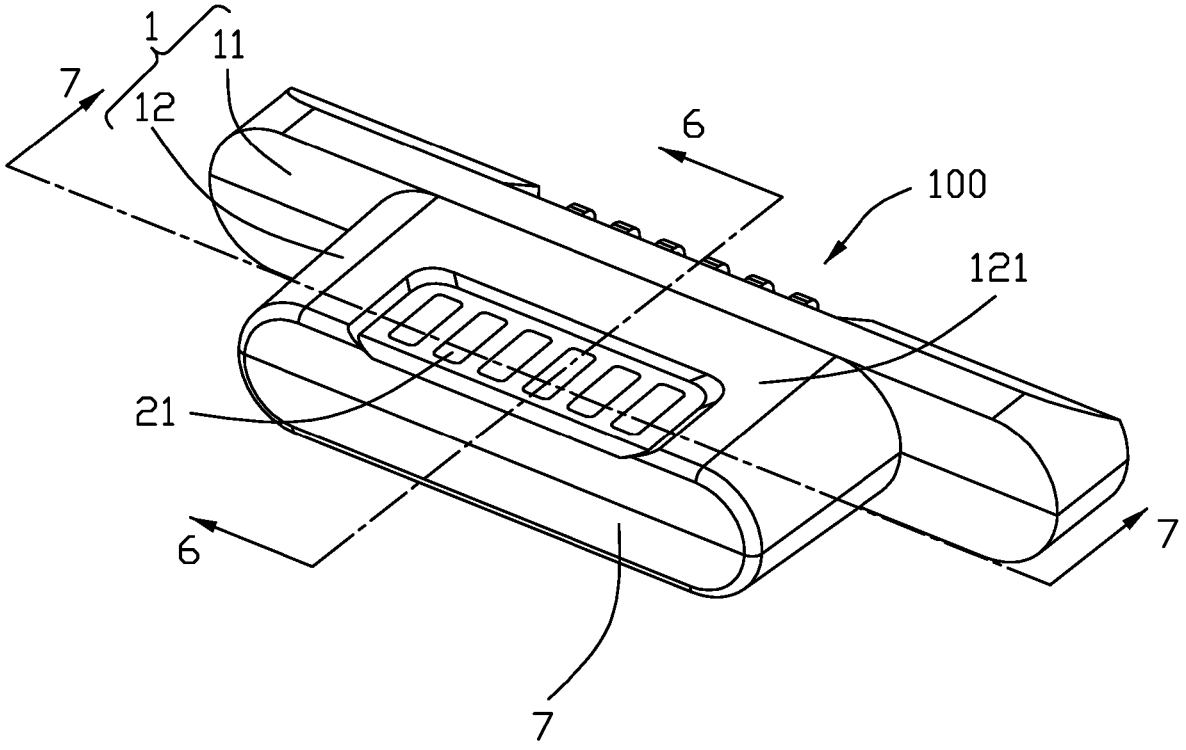
FIG. 1 is a perspective view of an electrical connector according to the present invention.
Figure 2:
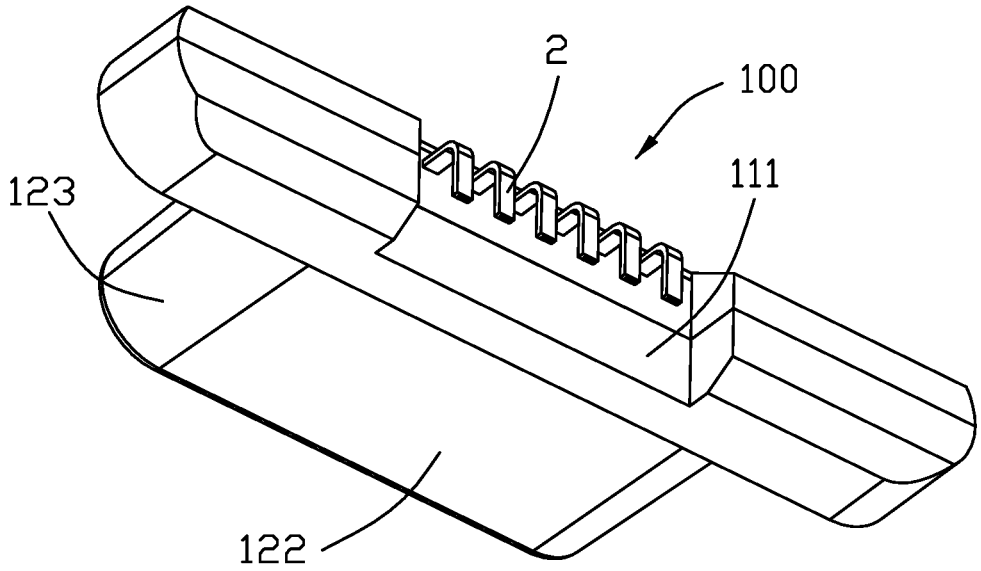
FIG. 2 is another perspective view of the electrical connector of FIG. 1.
Figure 3:
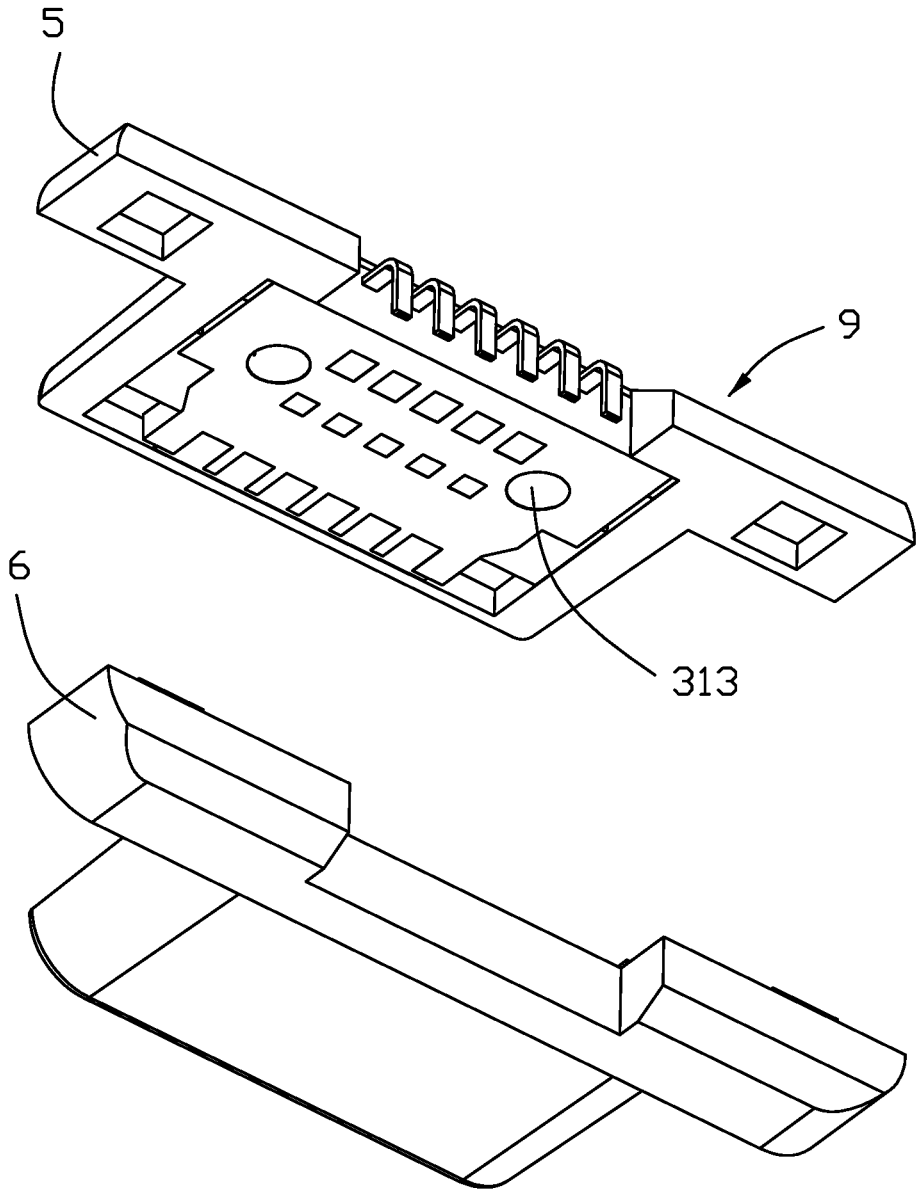
FIG. 3 is an exploded perspective view of the electrical connector of FIG. 1 before the lower cover is over-molded upon the remainder thereof.
Figure 4:
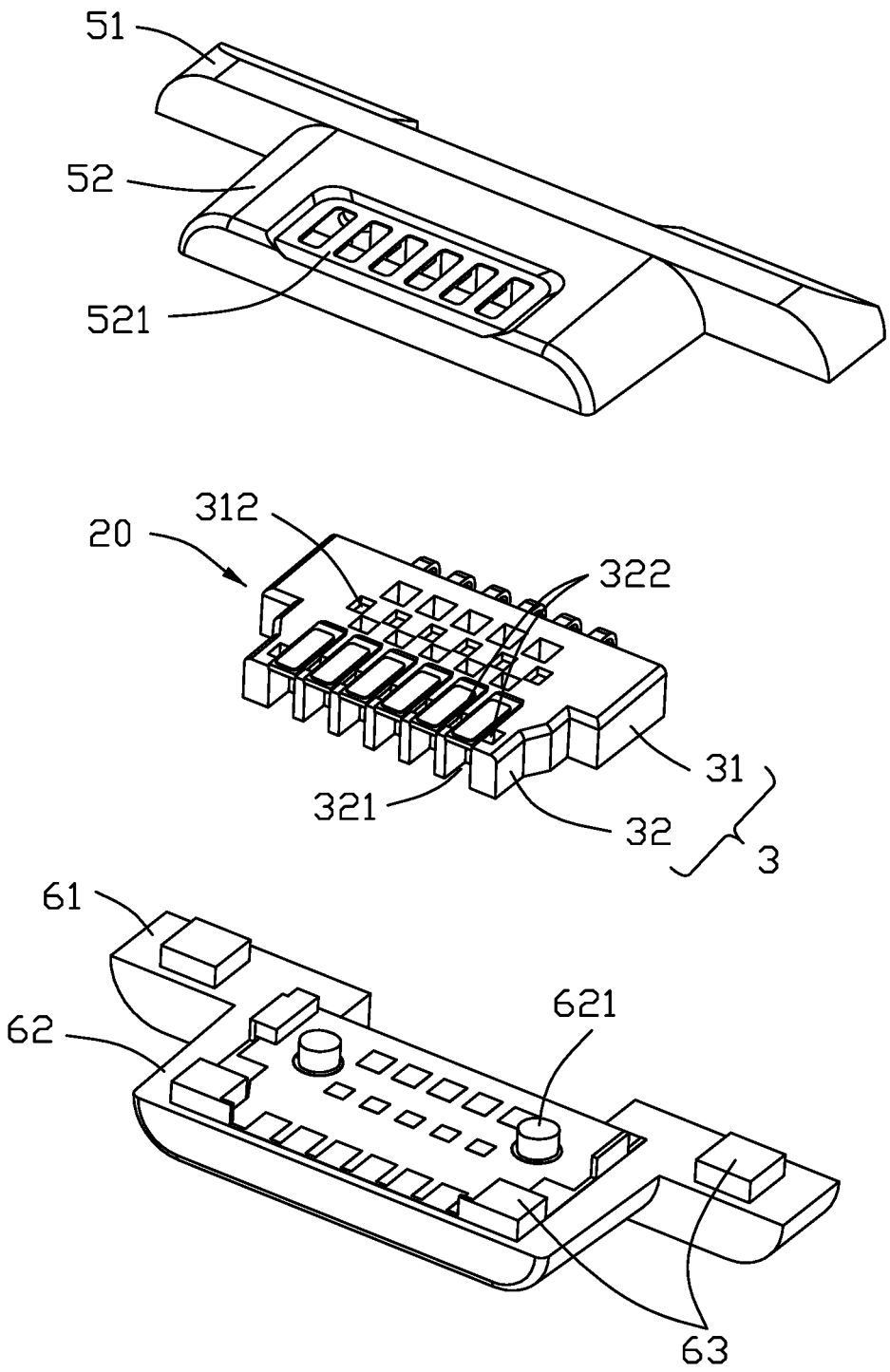
FIG. 4 is a further exploded perspective view of the electrical connector of FIG. 1 wherein both the upper cover and the lower cover are not over-molded upon the contact module.
Figure 5:
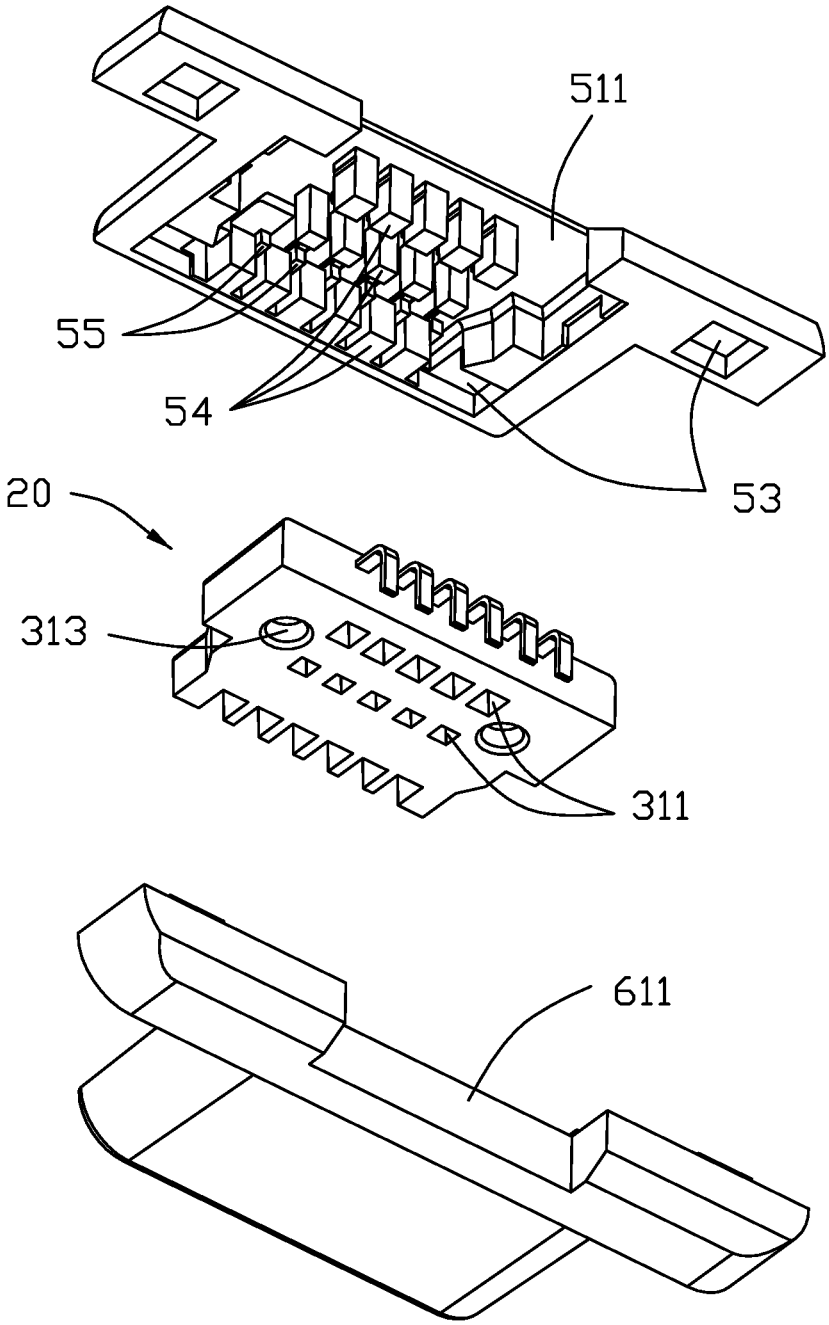
FIG. 5 is another exploded perspective view of the electrical connector of FIG. 1.
Figure 6:
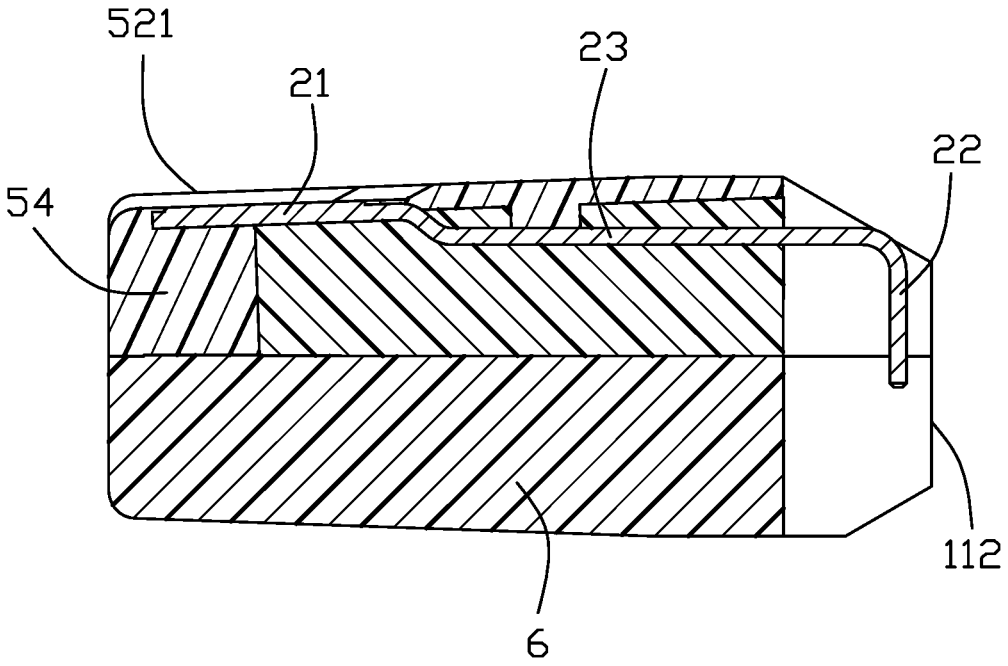
FIG. 6 a cross-sectional view of the electrical connector of FIG. 1 to show all the contacts are exposed upon only one tongue part in the vertical direction.
Figure 7:
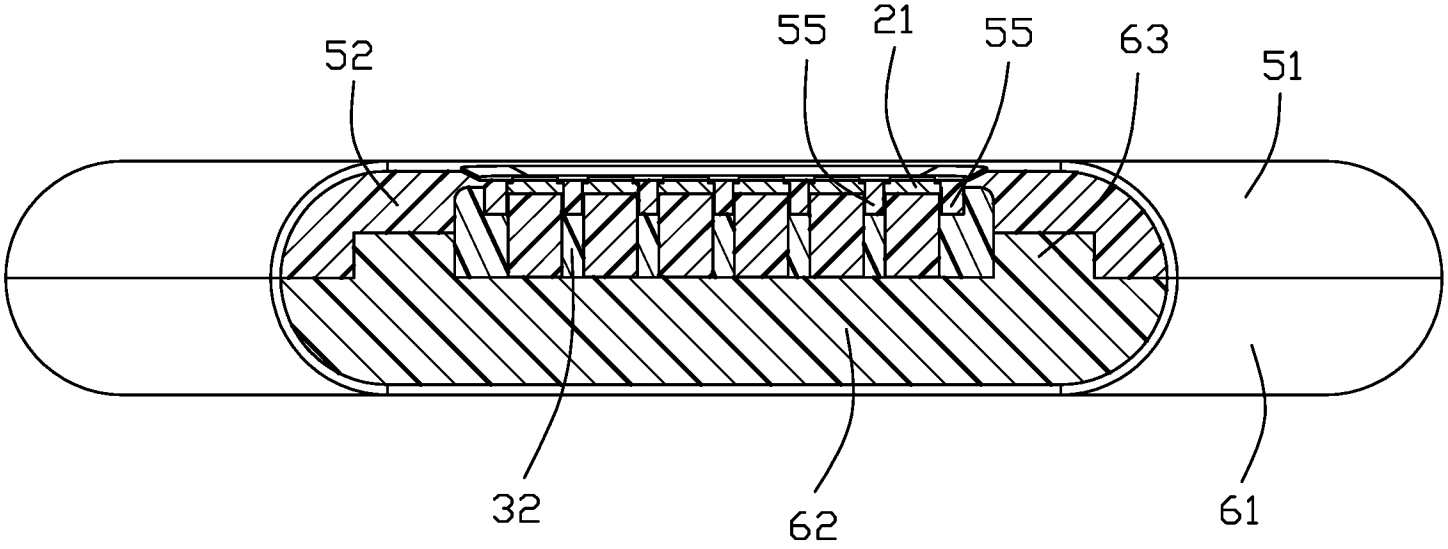
FIG. 7 is another cross-sectional view of the electrical connector of FIG. 1 to show how the contacts are retained in the insulator and the upper cover.

Referring to FIGS. 1-7, an electrical connector 100 includes an insulative housing 1 enclosing the contact module 20 therein. The contact module includes a plurality of contacts 2 retained in the insulator 3 via an insert-molding process. The housing 1 includes a rear base 11 and a front tongue 12. The front tongue 12 includes a pair of opposite primary faces wherein one is a mating face 121 and the other is a supporting face 122. A pair of side faces are linked between the mating face 121 and the supporting face 122. The contacts 2 include front contacting section s 21 exposed upon the mating face 121, rear tail sections 22 exposed outside of the base 11, an middle retaining sections 23 therebetween retained in the insulator 3.

The insulator 3 includes a rear base 31 and a front extension 32 extending forwardly from the base 31. The base 31 forms two rows of through holes 311 and one row of positioning holes 312 located between those two rows of through holes in the front-to-back direction and in staggered manner with those through holes 311 with an offset. The positioning holes 312 are downwardly communicatively aligned with the retaining sections 23 of the corresponding contacts 2 in the vertical direction, respectively, and upwardly exposed to an exterior. On the other hand, the through holes 311 are located by two sides of the corresponding contacts 2 in the transverse direction for allowing/receiving the corresponding core pins of the mold (not shown) or the so-called bridges, which are originally formed between the neighboring contacts for assuring the correct positions of the contacts while being removed after the insert-molding process, to sidewardly hold the contacts during the insert-molding process. The blind holes 322 are provided by two sides of the contacting sections 21 of the corresponding contacts 2 as well as the through holes 311. The contacting sections 21 are upwardly exposed to an exterior in the vertical direction. A plurality of recesses 321 are formed in a front portion of the extension 32 and located under front regions of the contacting sections 21 of the corresponding contacts 2, respectively. A pair of alignment/blind holes 313 are formed in the base 31 of the insulator 3.

The housing 1 includes an upper cover 5 and a lower cover 6 respectively over-molded upon opposite upper portion and lower portion of the contact module 20. A molding line 7 is formed in a front face of the housing 1. The contact module 20 is essentially enclosed within the upper cover 5 while the contacting sections 21 are exposed upon the mating face 121 and the bottom surface of the insulator 3 is downwardly exposed toward the lower cover 6 so as to have the pair of alignment holes 313 receive the corresponding alignment posts 621 extending upwardly from the lower cover 6.

The upper cover 5 includes an upper base 51 and an upper tongue 52 extending forwardly from the upper base 51. The upper tongue 52 forms a recessed mating region 521 terminated at the front edge thereof. The contacting sections 21 are flush with an upper surface of the mating region 521. The upper base 51. Two pairs of downward cavities 53 are formed in a bottom face of the upper base 51 to respectively receive the corresponding two pairs of protrusions 63 upwardly extending from the lower cover 6. A plurality of filling columns 54 of the upper cover 5 fill the corresponding through holes 311 and the recesses 321 of the insulator 3, thus enhancing retention between the upper cover 5 and the insulator 3. Similarly, as well as the relation between the filling columns 54 of the upper cover 5 and the through holes 311 and the recesses 321 of the insulator 3, the minor filling columns 55 of the upper cover 5 respectively fill the corresponding blind holes 322 which are originally used to receive the corresponding core pins of the mold during insert-molding process of the contact module 20.

The lower cover 6 includes a lower base 61 and the lower tongue 62 forwardly extending from the lower base 61. No part of the contacts 2 are positioned within the lower cover 6. The upper base 51 and the lower base 61 commonly form the base 11, and the upper tongue 52 and the lower tongue 62 commonly form the tongue 12. The mating face 121 is same with the top face of the upper cover 5, and the supporting face 122 is same with the bottom face of the lower cover 6. The side faces 123 are curved. The upper cover 5 forms an upper notch 511 and the lower cover 6 forms a lower notch 611 to commonly form a notch 111 so as to receive the tail sections 22 of the contacts 2 therein. In this embodiment, the tail section 22 do not extend rearwardly beyond the rear end face 112 of the base 11.

In manufacturing, the contacts 2 are integrally formed within the insulator 3 to form a contact module 20 via an insert-molding process. The upper cover 5 is firstly over-molded upon the contact module 20, via a first molding process, to form a subassembly 9 wherein the contacting sections 21 are exposed upon the mating face 121, and at least a portion of the bottom face of the insulator 3 is downwardly exposed so as to expose the alignment holes 313 of the insulator 3 as well as the downward cavities 53 formed in a bottom face of the upper cover 5. The lower cover 6 is secondly over-molded upon the bottom side of the subassembly 9, via a second over-molding process, wherein the protrusions 63 fill the corresponding cavities 53, and the alignment posts 621 fill the corresponding alignment holes 313 for assuring securing among all the contact module 20, the upper cover 5 and the lower cover 6. In this embodiment, the upper cover 5 and the lower cover are essentially dimensioned similar to each other, and the upper cover 5 and the lower cover 6 respectively cover the upper face and the lower face of the contact module 20 except the contacting sections 21 of the contacts 2 which are exposed to an exterior around the top face of the upper cover 5, wherein the contact module 20 is essentially embedded within the upper cover 5 and the bottom face of the contact module 20 is flush with the bottom face of the upper cover 5. In addition, a rear face of the lower cover 6 is flush with a rear face of the insulator 3 while the front face of the insulator 3 is covered by the upper cover 5. Notably, in this embodiment, the definition of the terms of "upper" or "lower", and "top" or "bottom" measured in the vertical direction are only relatively defined and can be switched, according to the viewer's position and angle.

What is claimed is:

1. An electrical connector comprising:

a contact module including a plurality of contacts integrally formed within an insulator via an insert-molding process, each of said contacts including a front contacting section, a rear tail section and a middle retaining section therebetween along a front-to-back direction;

an insulative upper cover applied upon at least a top face of the contact module, via a first over-molding process, to form a subassembly while exposing the front contacting sections upwardly to an exterior in a vertical direction perpendicular to the front-to-back direction; and an insulative lower cover applied upon said subassembly, via a second over-molding process, to cover at least a bottom face of the contact module; wherein no front contacting sections of the contacts are downwardly exposed to the exterior around a bottom face of the lower cover.

2. The electrical connector as claimed in claim 1, wherein a bottom face of the insulator is flush with a bottom face of the upper cover.

3. The electrical connector as claimed in claim 1, wherein a rear face of the lower cover is flush with a rear face of the insulator.

4. The electrical connector as claimed in claim 1, wherein a rear face of the insulator is rearwardly exposed to the exterior.

5. The electrical connector as claimed in claim 1, wherein a front face of the insulator is covered by the upper cover.

6. The electrical connector as claimed in claim 1, wherein the insulator originally forms a plurality of through hole and are successively filled with material of the upper cover after the upper cover is applied upon the contact module via the first over-molding process.

7. The electrical connector as claimed in claim 6, wherein said through holes are respectively intimately located by two sides of the corresponding contacts, viewed along said front-to-back direction.

8. The electrical connector as claimed in claim 1, wherein the insulator originally forms a plurality of downward alignment holes which successively receive corresponding alignment posts of the lower cover after the lower cover is applied upon the subassembly via the second over-molding process.

9. The electrical connector as claimed in claim 1, wherein no part of the insulator is downwardly exposed to the exterior around the bottom face of the lower cover.

10. The electrical connector as claimed in claim 1, wherein said insulator originally forms a plurality of positioning holes aligned with the corresponding contacts in the vertical direction, respectively, and said positioning holes are successively filled with material of the upper cover after the upper cover is applied upon the contact module via the first over-molding process.

11. The electrical connector as claimed in claim 10, wherein said insulator originally forms a plurality of recesses under the front contacting sections of the corresponding contacts in the vertical direction, respectively, and said recesses are filled with material of the upper cover after the upper cover is applied upon the contact module via the first over-molding process.

12. The electrical connector as claimed in claim 1, wherein the insulator forms a plurality of blind holes respectively located by two sides of the front contacting sections of the corresponding contacts and successively filled with material of the upper cover after the upper cover is applied upon the contact module via the first over-molding process.

13. The electrical connector as claimed in claim 1, wherein the upper cover forms, via the first over-molding process, a plurality of downward cavities which are successively filled with material of the lower cover after the lower cover is applied upon the subassembly via the second over-molding process.

14. A method of making an electrical connector, comprising steps of:

providing a contact module with a plurality of contacts integrally formed within an insulator via an insert-molding process wherein each of said contacts includes a front contacting section, a rear tail section and a middle retaining section in a front-to-back direction;

applying an upper cover upon the contact module via a first over-molding process to form a subassembly wherein the upper cover covers a top face of the contact module except the front contacting sections of the contacts upwardly exposed to an exterior in a vertical direction perpendicular to the front-to-back direction; and applying a lower cover upon the subassembly via a second over-molding process to cover a bottom face of the insulator; wherein no front contacting sections of the contacts are downwardly exposed to the exterior around a bottom face of the lower cover.

15. The method of making the electrical connector as claimed in claim 14, wherein a bottom face of the insulator is coplanar with a bottom face of the upper cover.

16. The method of making the electrical connector as claimed in claim 14, wherein a rear face of the insulator is aligned with a rear face of the lower cover in the vertical direction.

17. An electrical connector comprising:

a contact module including a plurality of contacts integrally formed within an insulator via an insert-molding process, each of said contacts including a front contacting section, a rear tail section and a middle retaining section therebetween along a front-to-back direction;

an insulative upper cover applied upon at least a top face of the contact module, via a first over-molding process, to form a subassembly while exposing the front contacting sections upwardly to an exterior in a vertical direction perpendicular to the front-to-back direction; and an insulative lower cover applied upon said subassembly, via a second over-molding process, to cover at least a bottom face of the contact module; wherein the upper cover and the lower cover are dimensioned similar to each other in all the front-to-back direction, the vertical direction and a transverse direction perpendicular to both the front-to-back direction and the vertical direction.

18. The electrical connector as claimed in claim 17, wherein a bottom face of the insulator is coplanar with a bottom face of the upper cover.

19. The electrical connector as claimed in claim 17, wherein the insulator of the contact module originally includes a plurality of holes of which some are successively filled with material of the upper cover and remainders are successively filled with material of the lower cover.

20. The electrical connector as claimed in claim 19, wherein the upper cover originally forms a plurality of holes which are successively filled with material of the lower cover.

* * * * *